US008127466B1

(12) United States Patent
Raval

(10) Patent No.: US 8,127,466 B1
(45) Date of Patent: Mar. 6, 2012

(54) FOOT CONDITIONING DEVICE AND METHOD

(76) Inventor: Pauravi Raval, Franklin Lakes, NJ (US)

( * ) Notice: Subject to any disclaimer, the term of this patent is extended or adjusted under 35 U.S.C. 154(b) by 501 days.

(21) Appl. No.: 12/378,669

(22) Filed: Feb. 18, 2009

(51) Int. Cl.
*A43B 5/12* (2006.01)
*A43B 7/14* (2006.01)

(52) U.S. Cl. ..... 36/8.3; 36/9 R; 36/140

(58) Field of Classification Search ..... 36/8.3, 36/11.5, 50.1, 9 R, 140
See application file for complete search history.

(56) References Cited

U.S. PATENT DOCUMENTS

| | | | | |
|---|---|---|---|---|
| 2,110,890 | A * | 3/1938 | Paul | 36/8.3 |
| 4,444,389 | A | 4/1984 | Wrucke | |
| 5,035,069 | A * | 7/1991 | Minden | 36/113 |
| 5,740,618 | A * | 4/1998 | Minden | 36/8.3 |
| 6,042,520 | A | 3/2000 | Cantero | |
| 6,857,203 | B2 * | 2/2005 | Minden | 36/8.3 |
| 6,895,694 | B2 * | 5/2005 | Nye | 36/8.3 |
| 7,041,075 | B2 | 5/2006 | Sullivan | |
| 7,685,739 | B2 * | 3/2010 | Aveni et al. | 36/8.3 |
| 2003/0145495 | A1 * | 8/2003 | Green | 36/145 |
| 2005/0022421 | A1 * | 2/2005 | Bruckner | 36/8.3 |
| 2005/0138839 | A1 | 6/2005 | Terlizzi et al. | |
| 2006/0143945 | A1 * | 7/2006 | Walker | 36/8.3 |
| 2007/0227045 | A1 * | 10/2007 | Aveni et al. | 36/54 |
| 2009/0151200 | A1 * | 6/2009 | Niedermeyer et al. | 36/88 |

FOREIGN PATENT DOCUMENTS

WO WO 9004338 A1 * 5/1990

* cited by examiner

*Primary Examiner* — Marie Patterson
(74) *Attorney, Agent, or Firm* — W. Patrick Quast, Esq.

(57) ABSTRACT

The device and methodology of the present invention promotes and maintains the user's Pointe position of the foot in a completely, at-rest, passive manner. It combines the technology of medical grade custom orthotics/insoles pre-shaped, including a subtalar neutral heel position, into the proper arched position of the user's foot position "en pointe", securing the toes to the device with Velcro®. A non-stretch, firm, breathable material such as canvas is the base of a self-adjustable lacing system that pulls the foot muscles onto the orthotic/insole to passively "teach" the foot muscles to conform and mimic the Pointe position. This self-adjusting feature of the lacing system allows constant correction and improvement of the foot muscles as they conform to the device. This leads to the formation of a near-perfect pointe position.

8 Claims, 7 Drawing Sheets

FOOT CONDITIONING DEVICE AND METHOD

FIELD OF THE INVENTION

This invention relates to a device and methodology used to train the foot to form an ideal Pointe position by training the foot muscles; and, more particularly, a device and method which enables the user to accomplish the end result without active participation in related dance or exercise, i.e. passively.

BACKGROUND OF THE INVENTION

Systems currently in place to form the ideal en pointe position, the position of maximum arch height and forefoot plantarflexion require active processes and/or equipment. These active processes include but are not limited to ballet barre work, costly lessons with a dance instructor, active rehabilitative work with a physical therapist, or equivalent, doing active stretching work that utilizes gym equipment, tension bands, weights, etc. There is no passive device that can be worn on the foot and self-adjusted at rest to achieve the Pointe position.

Heretofore the technique for facilitating the development of the muscles, ligaments and tendons associated with the En Pointe position in ballet have traditionally required active participation by the user, typically doing ballet bane work. Generally, the use of orthotic devices, traditionally had been within the environment of a complimenting shoe. This is worn by the user while engaging in active work whether, again, bane work or other dance and/or athletic activity.

Related patents or patent publications include US 2005/0138839; 2005/0022421; 2003/0145495; U.S. Pat. No. 7,041,075; U.S. Pat. No. 6,042,520 and U.S. Pat. No. 4,444,389. Each of these as noted above for the most part involves a device principally a shoe device which temporarily forms the foot and associated muscles necessary as one engages in the related activity. U.S. Pat. No. 6,042,520 may be considered a passive device. It is used as a warm-up device, presumably as a preliminary to dance or other gymnastic activity, to stretch and increase the flexibility of the foot. It is not directed to passive development over an extended period (several days or more) of related muscles, ligaments and tendons associated with any activity including, particularly, the en pointe dance position. Also, the heel is not retrained in a subtalar neutral position so ankle strain is possible with the '520 device.

OBJECTS

It is the primary object of this invention to provide a static, non-ambulatory footwear device and associated method, to train or rehabilitate the muscles, tendons and ligaments of the foot so as to aid in forming a user's en pointe foot profile so that it may be more easily and comfortably assumed during dancing or related activity.

It is a further object of the invention to use a solid formed insole member having a subtalar (neutral) heel portion to form the footwear device.

It is still another object of the invention to provide a solid insole member for the footwear device that is fashioned from a variety of heat molded, medical grade plastics (or other substances used in the creation of orthotics).

Yet another object of this invention is to include with the contoured insole a means for releasably holding the foot to the insole member so as to achieve proper alignment between the foot and the insole member.

A still additional object is to provide a slipper-type portion of the footwear device which includes a lacing system to secure substantially the entire foot firmly against the upper surface of the formed insole.

Another object of the invention is to fabricate the slipper-type portion out of suitable materials which aid the lacing system in holding the entire foot firmly to the insole member so that over a reasonable period of time the muscles, tendons and ligaments of the foot are manipulated to more readily assume a user's en pointe position during dancing or related activities.

SUMMARY OF THE INVENTION

Towards the accomplishment of these objects and others as well as further advantages which will be apparent after a reading of the within description, there is described a device and method for passively developing or rehabilitating those muscles, tendons and ligaments of a user's foot necessary to achieve and maintain a ballet dancer's en pointe position. In its broadest terms the invention comprises providing a foot conditioning device which includes a formed insole member having an upper surface. The formed insole member is configured in a shape resembling the en pointe profile of a ballet dancer's foot. The formed insole member has a heel end and a toe end. The heel end is formed in a subtalar neutral position for a particular user. This results in the locking of the ankle when the foot conditioning device is secured in place on the foot.

The foot conditioning device also includes means for releasably securing the user's foot to the formed insole member such that an under surface of the foot is maintained in continuous contact with the upper surface of the formed insole member along the length of latter. This is accomplished through means for contacting a plurality of positions of an upper surface of the user's foot from at least the instep in front of the ankle to the toe end.

In a preferred embodiment, the means for releasably securing the user's foot to the formed insole member include a slipper member. The slipper member has a bottom portion and an upper perimeter portion defining an opening and a length extending from the heel to the toe of the user. The formed insole member is disposed within the slipper member juxtaposed the bottom portion.

The means for releasably securing the user's foot to the formed insole member also include a lacing system. The lacing system includes a lace member and a plurality of lace retention means disposed at predetermined positions along the length of the upper perimeter portion of the slipper member. The lace member is threaded through an accommodating portion of each one of said plurality of lace retention means. The lace member is used to tighten the means for releasably securing the user's foot to the formed insole member such that said bottom portion of the slipper member is drawn towards and against a bottom surface of the formed insole member such that the upper surface of the formed insole member is drawn against the under surface of the foot and held there.

The methodology of the invention instructs the user to place its foot on the formed insole member by placing the foot on the insole such that the under surface of the foot is in contact with at least a portion of the upper surface from the heel end to the toe end.

Further the user is instructed to enable the means for releasably securing the user's foot to the formed insole member by overlaying the means for contacting the upper surface of the foot at various locations of the upper surface of the foot from a point on the toe end side of the ankle to the toe end and to tighten said means for releasably securing the user's foot to said formed insole member at least until a pressure on the foot is experienced that is comfortable to the user.

The methodology then instructs the user to keep the foot conditioning device on its foot for a period of time that comports with a respective development or rehabilitative plan for the user.

And still further, the methodology instructs the user to maintain a non-weight bearing body position while said foot conditioning device is secured to the user's foot, so as to minimize the amount of body weight supported by the foot with the foot conditioning device thereon.

Finally the methodology instructs the user to repeat the steps of securing the formed insole member to the foot periodically as may be called for in the user's respective development or rehabilitative plan.

In the preferred embodiment, the formed insole member includes means for securing the toes of the user to the toe end so as to retain the foot on the formed insole member as the slipper member is placed and secured on the foot.

DESCRIPTION OF THE PREFERRED EMBODIMENT

Consider now the following narrative with reference to the accompanying drawings wherein a preferred embodiment of the present invention is described. As a preferred embodiment, it is to be understood that alternatives to the structures described and methodology defined will be apparent to those of ordinary skill in this art. The scope of the invention therefore is to be measured only by the breadth of the claims which follow the accompanying description.

Figure 1:
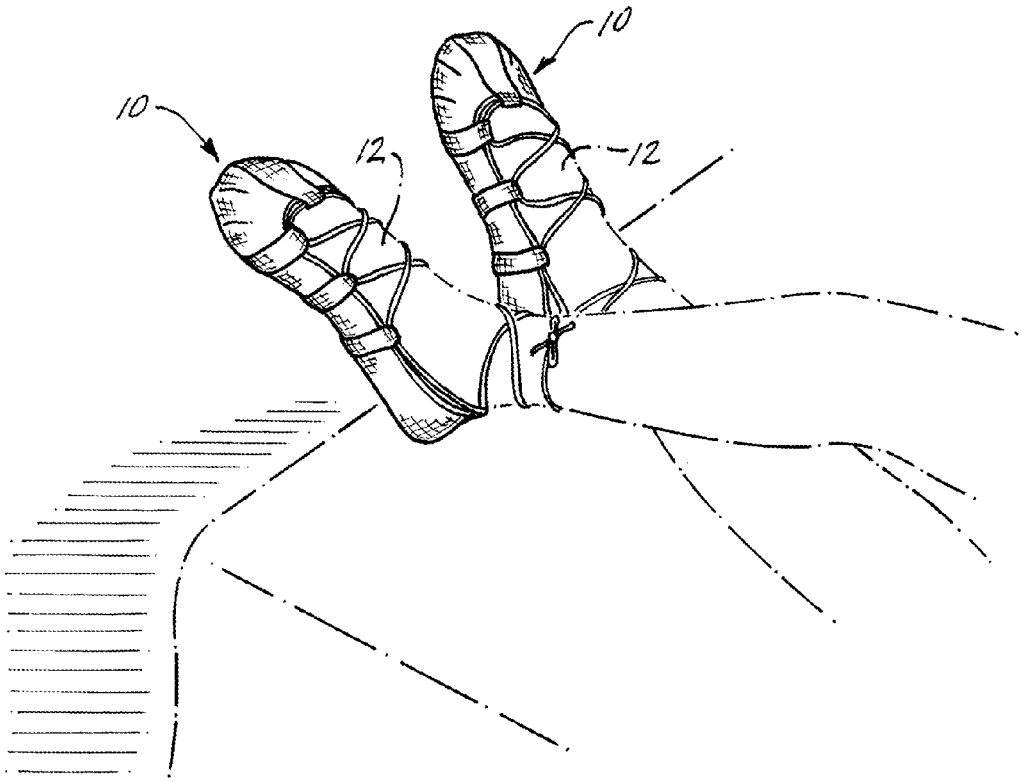
FIG. 1 is a perspective view of the device of the present invention, on the user's foot, as the user rests in a supine position.

In FIG. 1, the user is seen reclining in this case on a bed with the conditioning device 10 of the present invention in place on the user's foot 12. The significant feature of the present methodology and device is the ability to develop and/or rehabilitate those muscles, and associated tendons and ligaments of the user's foot necessary to achieve and maintain an en pointe position such as is needed if the user might be a ballet dancer. Further in this respect, in contrast with the prior art, it accomplishes this passively in that the user does not actively engage in the desired activity, such as ballet dancing with the device in place. Further, it is to be understood that the present device and methodology, is similarly used to benefit the user's conditioning for other activities; and is a significant enhancement to the rehabilitation of the associated muscles, tendons and ligaments where injury may have occurred.

In fact, it is anticipated that the present invention will be helpful in reconstructing those muscles, tendons and ligaments which will eliminate a flat foot condition. Instead of exercise, the present invention allows the user to assume a passive body posture such as reclining on a bed 14, sitting in a chair, etc.

Figure 2:
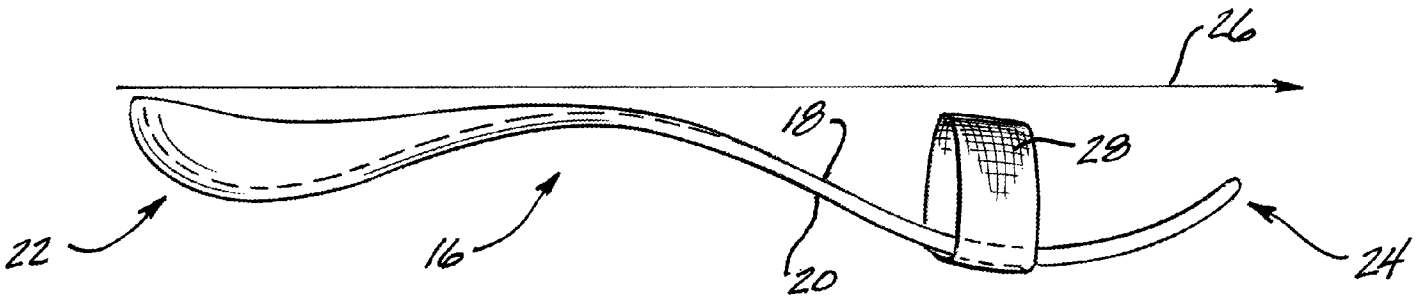
FIG. 2 is a side elevation view of a portion of the present invention.
Figure 3:
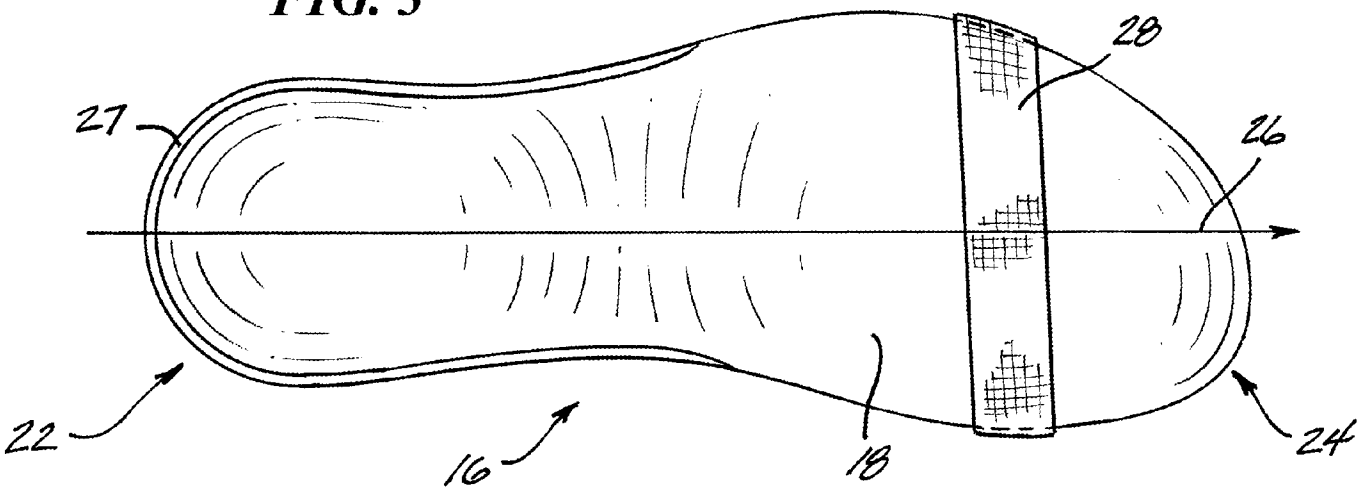
FIG. 3 is a top plan view of FIG. 2.

FIGS. 2 and 3 depict the side and top profiles of the formed insole member 16 portion of the present invention. The formed insole member corresponds in length and width to the user's shoe size. It includes an upper surface 18 and lower surface 20. And further comprises a heel end portion 22 and toe end portion 24. The formed insole member is oriented from its heel to its toe end in the direction of a first axis 26.

The formed insole member as seen in FIG. 2 reflects the En Pointe profile of a ballet dancer's foot. It comprises typically a pre-formed thermoplastic orthotic insole in ideal plantarflexion of the foot with a deep heel cup in subtalar neutral position. The orthotic device is formed by placing the user's foot in a mold so as to produce the heel segment in the subtalar neutral position. Thereafter, the mold of the heel is joined with the mold for a respective one of several pre-formed orthotic insoles that include the en pointe formation for the mid section and toe portion of the foot. A customized insole member is formed as required for the particular user. The subtalar neutral position works to lock the ankle in place when the conditioning device 10 is secured to the user's foot. The fact that the insole member locks the ankle in place prevents inversion ankle injuries. Since the device is used at rest, and holds the heel in a neutral position via the orthotic insole member, the ankle is held in a locked position (called the subtalar neutral position) thus minimizing ankle ligament injuries associated with an unlocked ankle (usually inverted ankle with foot in plantarflexion) during active exercise. The heel end also includes a raised rim-like portion 27 which somewhat facilitates foot placement on the insole member.

Figure 4:
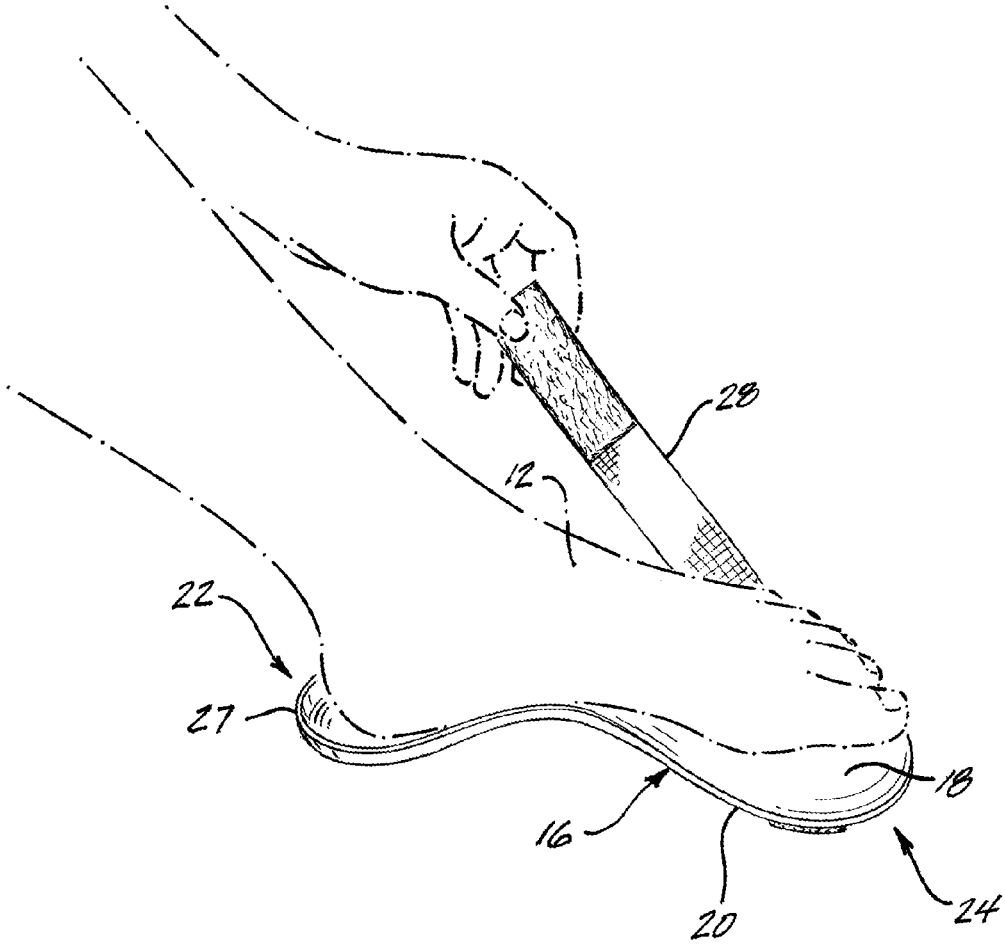
FIG. 4 is a perspective view of the user of the present invention placing a portion of the invention on the user's foot.

A retaining strip 28 is retentively secured to the lower surface 20 at the toe end of the formed insole member. It loops over the top insole member 16 and is used to first secure the forefoot and toe portion of the user's foot to the insole member. See FIG. 4. Various techniques can be utilized to secure one end of the retentive member 28 to the formed insole member sized to provide a means for securely retaining the toe end of the foot when the user draws the ends of the strip together. Typically, a Velcro® brand fastener is used. The Velcro® brand fastener, once again, maintains the position of the foot in relationship to the formed insole member from the heel portion along the length of the axis 26 to the toe portion. Consequently, it locates respective muscles, ligaments and tendons of the foot to corresponding respective portions of the insole member. Other type fasteners can be employed provided they accomplish the purpose of retaining the foot on the insole member in a manner such that there is little or no movement in the direction of axis 26 as the remaining portion of the foot conditioning device is assembled to the foot and insole member.

Figure 5:
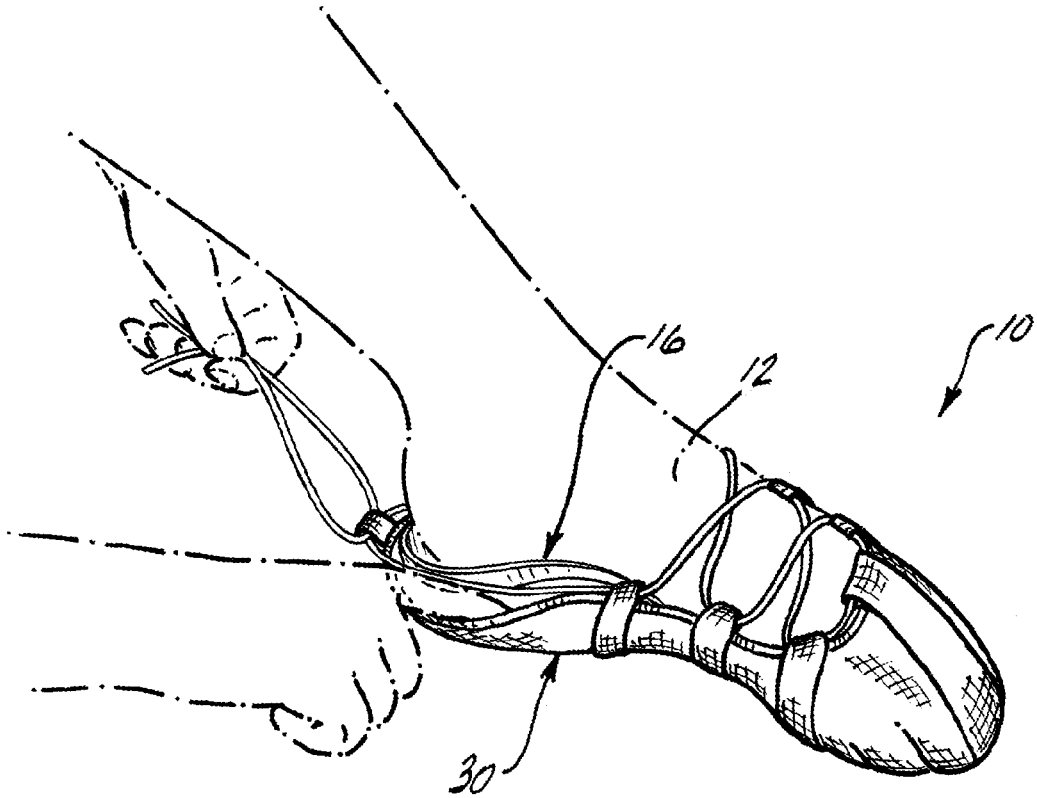
FIG. 5 is a further step in the process of the present invention.

Once the foot is secured on the insole member, they are both then inserted into a slipper member 30 as seen in FIG. 5.

The means for releasably securing the user's foot to the formed insole member includes the slipper-like member 30. FIG. 5 depicts the user manipulating the heel portion of the slipper member over the corresponding segment of the insole member until it fully encompasses the heel to toe portion of the user's foot exclusive of the instep.

Figure 6:
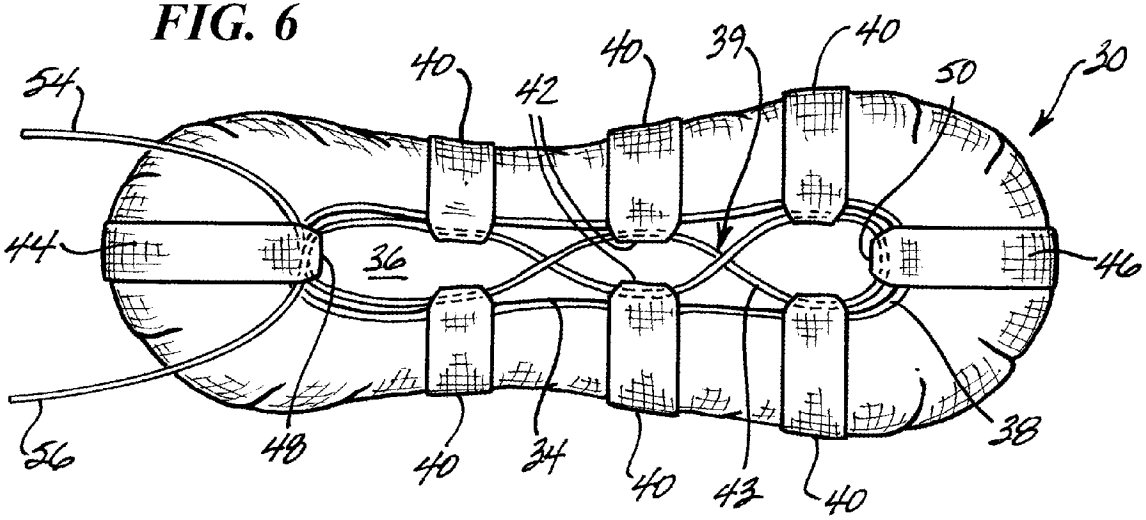
FIG. 6 is a top plan view of the slipper member of the present invention.
Figure 7:
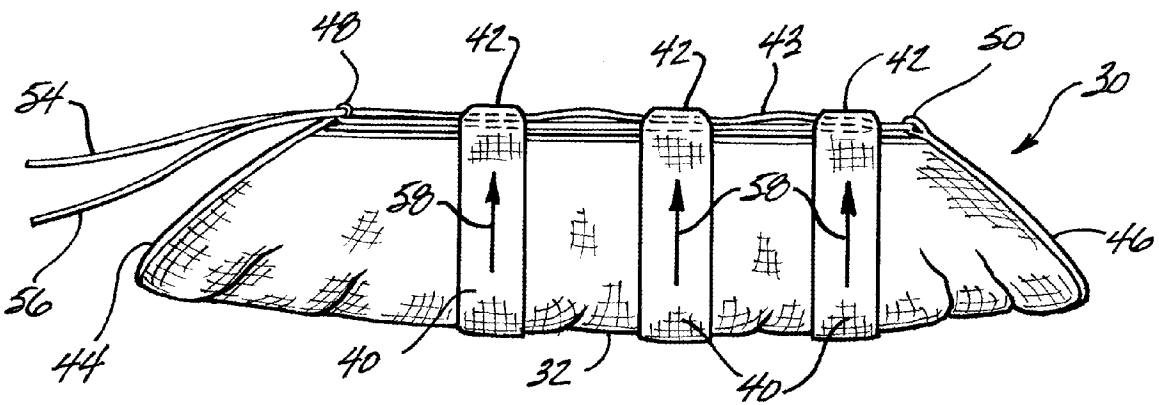
FIG. 7 is a side elevation view of the slipper member.
Figure 8:
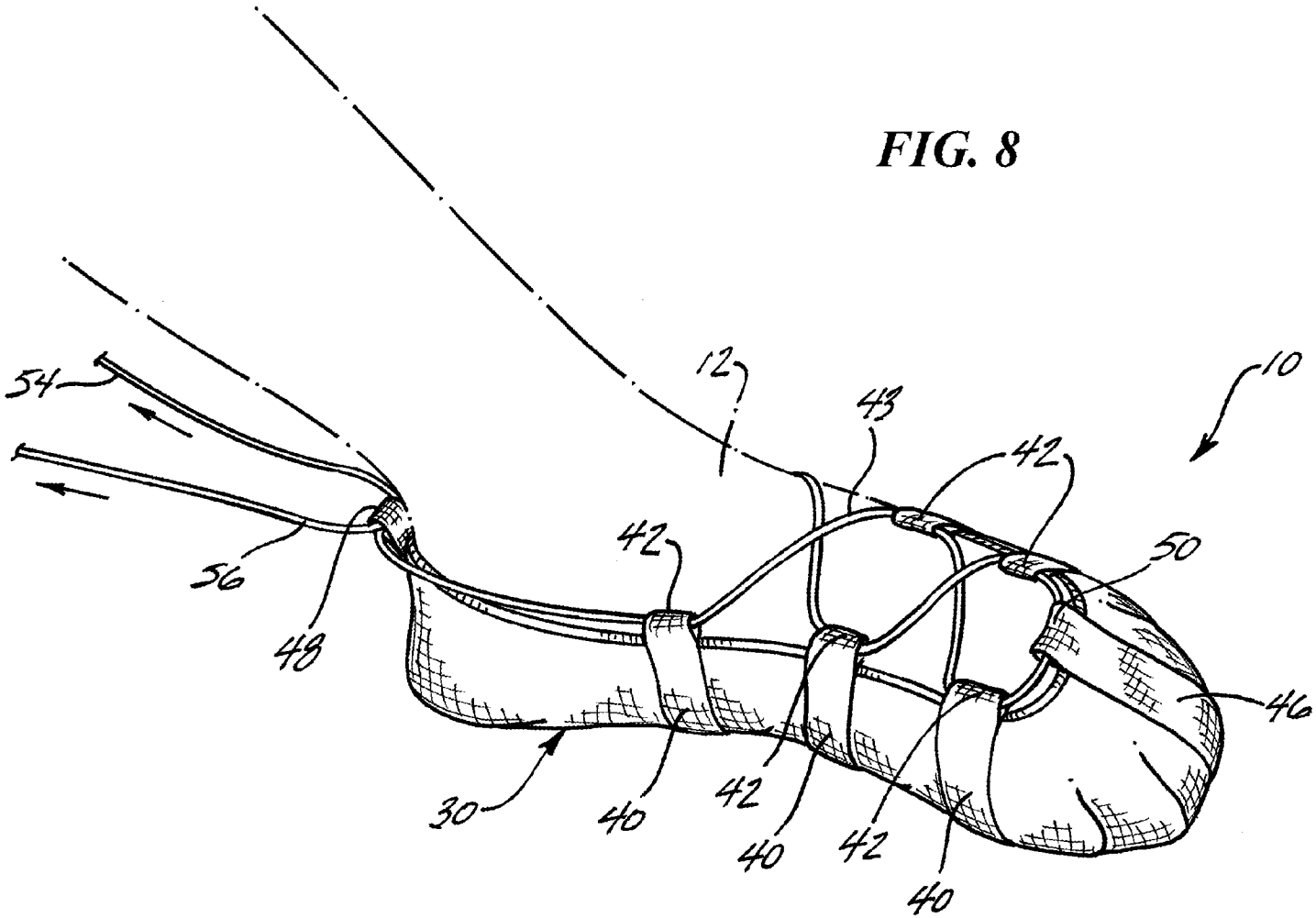
FIG. 8 is a perspective view of a further step in the method of the present invention.

In FIGS. 6, 7 and 8 the slipper-type member is shown in a top plan view, side elevational view and perspective view respectively. It typically is made from canvas but it is anticipated that lycra, spandex, leather or similar materials can be used. It includes a bottom portion 32 and an upper perimeter portion 34 which defines an opening 36 through which the foot is passed. An elastic material 38 circumscribes the perimeter portion 34. The elastic retains the perimeter portion to the top side of the foot to facilitate the lacing of the slipper.

A lacing system is incorporated as part of the means for releasably securing the user's foot. The lacing system 39 includes a plurality of anchor members 40, typically ribbon-like in size but can also be eyelets. These are secured to the side of the slipper by various means such as stitching; and are disposed on respective side portions at oppositely positioned locations along the length of the opening defined by the perimeter portion 34. The end of the ribbon-like, anchor member 40 is formed in a loop 42 to permit the passing of a lace member 43 therethrough. Further ribbon-like anchor members, 44 and 46, are secured to the heel and toe end of the slipper. They include corresponding loops 48 and 50. The lace member 43 is first passed through toe loop 50. It then criss-crosses over the instep and passes through alternating loops 40 in the manner of lacing a shoe. The ends of the lace member are threaded through the heel loop 48.

Once the slipper is in place on the foot after the completion of the activity depicted in FIG. 5, the user draws on the end segments 54 and 56 of the lace 43. The force exerted on these end members draw respective portions of the slipper side upwards in the direction 58 as viewed in FIG. 7. The bottom portion 32 is drawn upward and against the undersurface 20 of the formed insole member 16.

Figure 9:
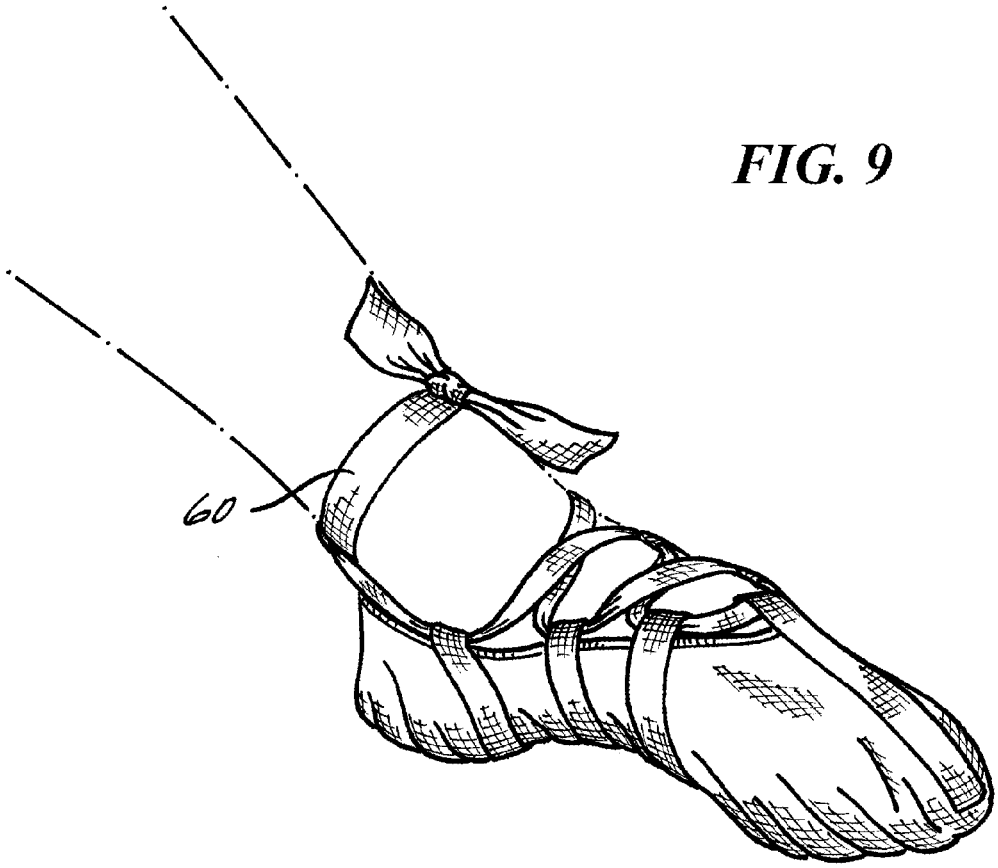
FIG. 9 is a perspective view of an alternate embodiment of the present invention when finally installed on the user's foot.

FIG. 9 depicts an alternate embodiment of the slipper device described above. In this embodiment, the lace member is replaced by a ribbon member 60. FIG. 9 shows the tying of the lace (ribbon) ends on the instep side of the ankle; as well as the drawing up of the bottom surface 32 against the under surface 20 of the insole member 16.

Either through instruction by a skilled instructor or through written instructions accompanying the foot conditioning device, the user is instructed to place his or her foot on the orthotic device constituting the formed insole member. She is then instructed to take the Velcro® brand fastener or retentive member 28 and draw it over the toes and forefoot so as to orientate the foot effectively along axis 26 and then to secure the forefoot and toes to the front of the insole by securing the retentive member 28 to its other end, secured to the under surface 20 of the insole member 24.

The user is then instructed to place their foot into the respective slipper member 30; to draw up the slack in the lace member 52 crossing the ends of the lace member in front of the instep and securing the laces together in a known manner.

The user is advised to exert a force on the lace member until a comfortable feeling of snugness is obtained.

The user is further instructed that she/he is not to engage in any activity while the conditioning device is in place and is recommended, ideally, to be off her/his feet so as to eliminate any pressure on the device while in place.

The user is further instructed to draw up on the lace member from time to time to continually improve the snugness of the fit between the insole member and the undersurface of the foot.

The foot conditioning device will be worn preferably on a regular basis over an entended period of time, typically lasting four to six weeks. The insole member is best fitted by a skilled professional such as a podiatrist. When the insole member is available, the skilled professional or directions accompanying the conditioning device will instruct the user in how the conditioning device is to be placed on the foot. Further instructions will include the need to develop a personal plan which typically will include the need to periodically, preferably on a day to day basis, install the conditioning device on the feet for a particular period of time during the day which agrees with the user's personalized plan. The instructions will further make it clear how the device is to be assembled on the foot. Further the skilled professional or the instructions will direct the user to remain off their feet when the device is in place.

The device of the present invention has been tried with over 120 dancers over the course of three months. The ages of the dancers ranged between 4 and 16 years of age and included both boys and girls. The students were given the package directions for fit. All students improved by 90% in the conformation of their foot to the Pointe position in the device, as well as the ability to form the Pointe position within a ballet-type shoe without the device. Improvement occurred by 28 days on the average. With this device, the foot can continue to improve after 28 days with use of the lacing system to pull involved muscles of the foot and leg to the orthotic device. Success was determined by conformation of the plantar surface of the foot to the device and the ability to form Pointe close to the orthotic mold without the device. Additionally, the heel in subtalar neutral position resulted in no ankle strain while device was on or off during the three month period.

In view of the description and accompanying drawings, it is apparent that variations on the respective means used to accomplish its purposes will be apparent to those of ordinary skill in the art. The invention of course is not to limited by the description set forth above, but rather by the breadth of the claims that follow.

What is claimed:

1. A method for passively developing or rehabilitating those muscles, tendons and ligaments of a user's foot necessary to achieve and maintain a ballet dancer's en pointe position comprising:

(a) providing a foot conditioning device, said foot conditioning device including, (i) a formed insole member having an upper surface, said formed insole member configured in a shape resembling the en pointe profile of a ballet dancer's foot, said formed insole member having a heel-end and a toe-end and a first axis extending from said heel-end to said toe-end, said heel-end formed in a subtalar neutral position for a particular user whereby the ankle is locked when said foot conditioning device is secured to the foot after step (d) hereinafter, said heel-end of the formed insole member including a raised, rim-like portion to facilitate placement of the heel-end of the foot on said formed insole member such that said heel-end of the foot is maintained in the subtalar neutral position due to its placement on the formed insole member, throughout steps (c) through (g) of the claimed method; and, (ii) means for releasably securing the user's foot to said formed insole member such that an under surface of the foot is maintained in continuous contact with said upper surface of said formed insole member along the length of said first axis, said means for releasably holding including means for contacting a plurality of positions of an upper surface of the user's foot from the heel-end to the toe-end;

(b) instructing the user to place its foot on said formed insole member by placing the foot on the insole such that the heel-end of the foot is disposed in juxtaposition to said raised, rim-like portion of said heel-end of the formed insole member, and such that the under surface of the foot is in contact with at least a portion of said upper surface from said heel-end to said toe-end;

(c) instructing the user to enable said means for releasably securing the user's foot to said formed insole member including the step of overlaying said means for contacting on the upper surface of the foot at various locations of the upper surface of the foot from a point on the toe-end side of the ankle to the toe-end;

(d) instructing the user to tighten said means for releasably securing the user's foot to said formed insole member at least until a pressure on the foot is experienced that is comfortable to the user;

(e) instructing the user to keep the foot conditioning device on its foot for a period of time that comports with a respective development or rehabilitative plan for the user;

(f) instructing the user to maintain a non-weight bearing body position while said foot conditioning device is secured to the user's foot as per step (e) above, so as to minimize the amount of body weight supported by the foot with the foot conditioning device thereon;

(g) instructing the user to repeat the steps of securing the formed insole member to the foot periodically as may be called for in the user's respective development or rehabilitative plan, said formed insole member retaining its en pointe profile with the heel-end of the foot in a subtalar neutral position, when said foot conditioning device is in place on the user's foot in the non-weight bearing body position.

2. The method claimed in claim 1 wherein the step of instructing as set forth in steps b, c, d, e, f and g of claim 1 are accomplished by verbal direction from at least one other person.

3. The method claimed in claim 1 wherein the step of instructing as set forth in steps b, c, d, e, f and g of claim 1 are accomplished at least in part by written material.

4. The method claimed in claim 1 wherein said means for releasably securing the user's foot to said formed insole include (a) a slipper member, said slipper member having a bottom portion and an upper perimeter portion defining an opening and a length extending from the heel to the toe of the user, said insole disposed within said slipper member;

(b) a lacing system, said lacing system including a lace member and a plurality of lace retention means disposed at predetermined positions along the length of said upper perimeter portion of said slipper member which extends from the heel to the toe of the user, said lace member threaded through an accommodating portion of each one of said plurality of lace retention means as determined by the user so as to accomplish the step of overlaying as called for in step (c), said lace member used to tighten said means for releasably securing the user's foot to said formed insole as called for in step (d) of claim 1.

5. A foot conditioning device, said foot conditioning device including, (a) a formed insole member having an upper surface, said formed insole member configured in a shape resembling the en pointe profile of a ballet dancer's foot, said formed insole member having a heel-end and a toe-end and a first axis extending from said heel-end to said toe-end, said heel-end at least formed in a subtalar neutral position for a particular user whereby the ankle is locked when said foot conditioning device is secured to the foot; and, (b) means for releasably securing the user's foot to said formed insole member such that an under surface of the foot is maintained in continuous contact with said upper surface of said formed insole member along the length of said first axis, said means for releasably holding including means for contacting a plurality of positions spaced along an upper surface of at least the instep area of the user's foot to the toe-end, said formed insole member retaining its en pointe profile with said heel-end in a subtalar neutral position when said foot conditioning device is in place on the user's foot and the user maintains a non-weight bearing body position, said heel-end of the formed insole member including a raised, rim-like portion to facilitate placement of the heel-end of the foot on said formed insole member where the heel-end of the foot is located in juxtaposition to the raised, rim-like portion.

6. The foot conditioning device claimed in claim 5 wherein said means for releasably securing the user's foot to said formed insole include, (i) a slipper member, said slipper member having a bottom portion and an upper perimeter portion defining an opening and a length extending from the heel to the toe of the user, said formed insole member disposed within said slipper member juxtaposed said bottom portion;

(ii) a lacing system, said lacing system including a lace member and a plurality of lace retention means disposed at predetermined positions along the length of said upper perimeter portion of said slipper member which extends from the heel to the toe of the user, said lace member threaded through an accommodating portion of each one of said plurality of lace retention means, said lace member used to tighten said means for releasably securing the user's foot to said formed insole member such that said bottom portion of said slipper member is drawn towards and against a bottom surface of said formed insole member such that said upper surface of said formed insole member is drawn against the under surface of the foot and held there.

7. The foot conditioning device claimed in claim 6 wherein said formed insole member includes means for securing the toes of the user to said toe-end so as to retain the foot on the formed insole member as said slipper member is placed on the foot.

8. The foot conditioning device claimed in claim 5 wherein said formed insole member includes means for securing the toes of the user to said toe-end so as to retain the foot on the formed insole member as said slipper member is placed on the foot.

* * * * *